United States Patent [19]

Parraud et al.

[11] Patent Number: 4,825,188

[45] Date of Patent: Apr. 25, 1989

[54] METHOD OF MANUFACTURING A LIGHTNING ARRESTER, AND A LIGHTNING ARRESTER OBTAINED BY THE METHOD

[75] Inventors: René Parraud, Chateldon; Denis Thuillier, Vichy, both of France

[73] Assignee: Ceraver, Courbevoie, France

[21] Appl. No.: 163,676

[22] Filed: Mar. 3, 1988

[30] Foreign Application Priority Data

Mar. 6, 1987 [FR] France ..... 87 03049

[51] Int. Cl.[4] ..... H01C 7/10

[52] U.S. Cl. ..... 338/21; 361/127; 29/592.1

[58] Field of Search ..... 338/21; 29/592 R; 361/117, 127, 118

[56] References Cited

U.S. PATENT DOCUMENTS

| | | | |
|---|---|---|---|
| 4,262,318 | 4/1981 | Shirakawa et al. | 361/127 |
| 4,587,592 | 5/1986 | Nakano et al. | 338/21 X |
| 4,638,285 | 1/1987 | Lott | 338/21 |
| 4,729,053 | 3/1988 | Maler et al. | 361/118 |

FOREIGN PATENT DOCUMENTS

| | | |
|---|---|---|
| 0008181 | 2/1980 | European Pat. Off. . |
| 0196370 | 10/1986 | European Pat. Off. . |
| 2073965 | 10/1981 | United Kingdom . |

*Primary Examiner*—E. A. Goldberg
*Assistant Examiner*—M. M. Lateef
*Attorney, Agent, or Firm*—Sughrue, Mion, Zinn, Macpeak, and Seas

[57] ABSTRACT

The present invention relates to a method of manufacturing a lightning arrester (100) having two end fittings (2,20) at either end of a substantially cylindrical central core constituted by a stack of pellets (6, 7, 8) made of a varistor-type material and having holes therethrough whereby the pellets are threaded over a central rod (1) made of stratified material. The stack assembly is put into compression against the two facing faces of the end fittings (2, 20) by means of the rod (1), the space between the rod (1) and the pellets (6, 7, 8) is filled by casting or injecting an insulating material, with the assembly obtained in this way being perfectly rigid, and a coating (30) of an elastomer of the EPDM type is molded over the assembly, with the coating adherring perfectly to all of the surfaces of the core and of the end fittings which it covers.

9 Claims, 4 Drawing Sheets

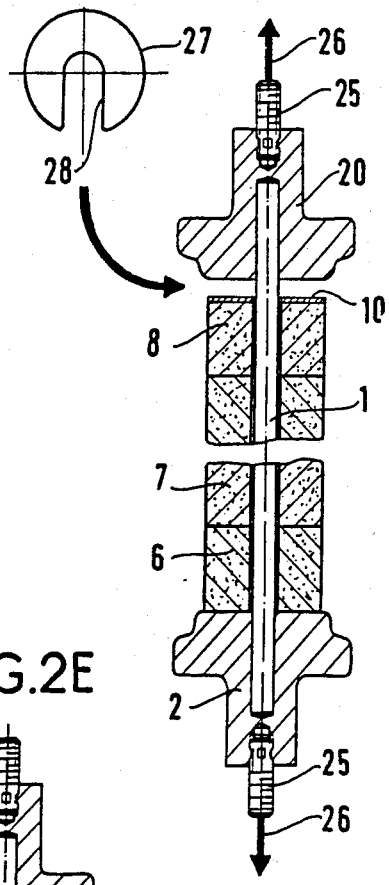
FIG.2D
FIG.2E
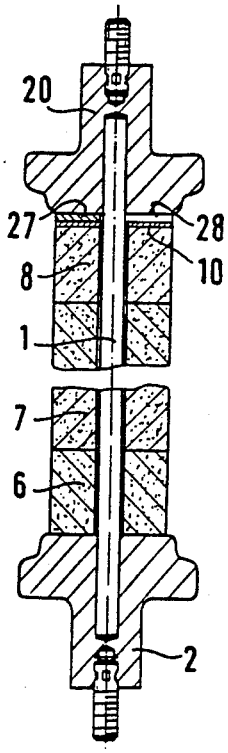
FIG.2F
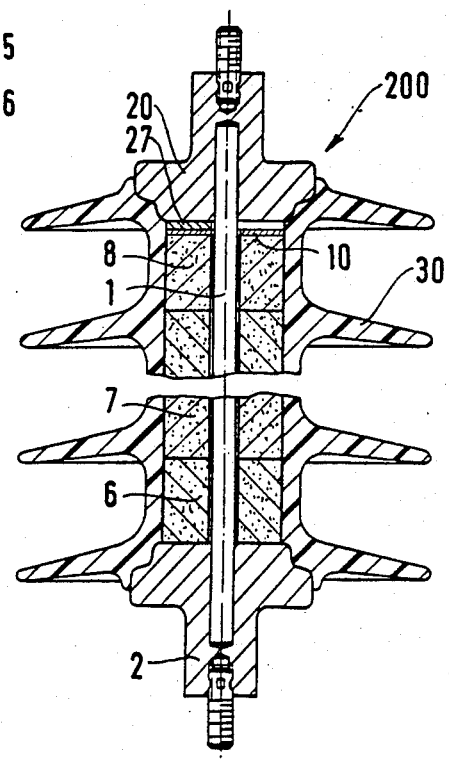

METHOD OF MANUFACTURING A LIGHTNING ARRESTER, AND A LIGHTNING ARRESTER OBTAINED BY THE METHOD

The present invention relates to a method of manufacturing a lightning arrester, and to a lightning arrester obtained by the method.

BACKGROUND OF THE INVENTION

A lightning arrester is a device placed between a phase and ground in a high tension line, and which serves to limit the amplitude and the duration of atmospheric over-voltages (surges due to lightning and to induction phenomena in the conductors), or to temporary electrical over-voltage on the grid (operating surges).

The functions of a lightning arrester are firstly to withstand normal operating tension on a permanent basis, and secondly to pass the high discharge current which appears during a temporary surge, thereby protecting line apparatuses (transformers, . . . ).

These functions are generally provided by a core made of a material of the varistor type and based, for example, on zinc oxide ZnO whose electrical resistivity is highly non-linear as a function of applied voltage.

This non-linear characteristic enables such a lightning arrester to pass:

a low current (e.g. about 0.5 mA/cm$^2$) when the operating voltage is applied on a permanent basis to the lightning arrester which then presents a very high resistance, this current is essentially capacitive in origin since the relative permitivity of such varistors is very high; or a high current which may be as high as several tens of kiloamps, when the applied voltage reaches a trigger threshold above which the resistance to the varistor becomes very low.

Various lightning arrester structures are known using a central core comprising a plurality of stacked cylindrical pellets of varistor type material, with two end fittings coming into contact with the pellets by means of spring blades, for example.

Thus, in British patent application No. 2 073 965 a central core is described comprising a plurality of stacked cylindrical pellets having a hole through which an insulating rod is passed in order to give said core a degree of mechanical stiffness. The central core and the two end fittings are mechanically held together by a common heat-shrink envelope.

Such a disposition does not always give results that are electrically satisfying since a heat-shrink envelope can never perfectly clamp onto the side walls of the stack of pellets. In particular, the envelope does not occupy surface defects in the central core, which defects may be due to the surface state per se of each pellet or else to defects in the centering of the pellets relative to one another. The presence of air between the core and the heat-shrink envelope or between the core and the central rod may give rise, in the end, to electrical arcing activity inside the lightning arrester which is prejudicial to proper performance of the lightning arrester.

Preferred implementations of the present invention provide a low cost lightning arrester which avoids the drawbacks of the above-described arresters.

SUMMARY OF THE INVENTION

The present invention provides method of manufacturing a lightning arrester comprising two end fittings at respective ends of a central core which is substantially cylindrical and constituted by a stack of pellets made of a varistor-type material, said pellets having holes passing therethrough whereby they are threaded over a central rod made of stratified material, the method including the following steps:

said stack assembly is put into compression by means of said rod between the two facing faces of said end fittings;

the space between the rod and said pellets is filled by casting or injecting an insulating material, with the assembly thus constituted being perfectly rigid; and a coating of an elastomer of the EPDM type is molded over said assembly and adhers perfectly to all of the surfaces of the core and the end fittings which it covers.

In a particular embodiment, said core includes slotted metal spacers interposed between the pellets; and by virtue of the slots, the space between the rod and the pellets is filled with elastomer when said coating is molded thereover.

In order to compress said stack of pellets against the two facing faces of said end fittings, the following operations may be performed:

a first end of said rod is fixed in a first end fitting;

said pellets are threaded over said rod;

the second end of said rod is fixed in the second end fitting;

the resulting assembly is put under longitudinal traction so as to obtain a space within the stack enabling a slotted wedge to be received therein; and the traction is released.

The thickness of the wedge is chosen as a function of the desired pre-stress load on the pellets.

Said wedge may be placed between two pellets or between a pellet and one of said end fittings. Naturally, electrical continuity must be ensured in all cases between the wedge and the facing face of the pellet by means of a metal washer.

In another embodiment, said pellets are held together with the rod under longitudinal compression by means of springs disposed between said faces of said end fittings and the ends of said stack of pellets.

The ends of the rod may be fixed to the insides of their respective end fittings by gluing or by crimping.

BRIEF DESCRIPTION OF THE DRAWINGS

Implementations of the invention are described by way of example with reference to the accompanying drawings, in which:

FIGS. 2A to 2F are diagrammatic fragmentary sections showing the various stages of the method in accordance with the invention leading up to a lightning arrester (FIG. 2F) analogous to that shown in FIG. 1.

MORE DETAILED DESCRIPTION

Figure 1:
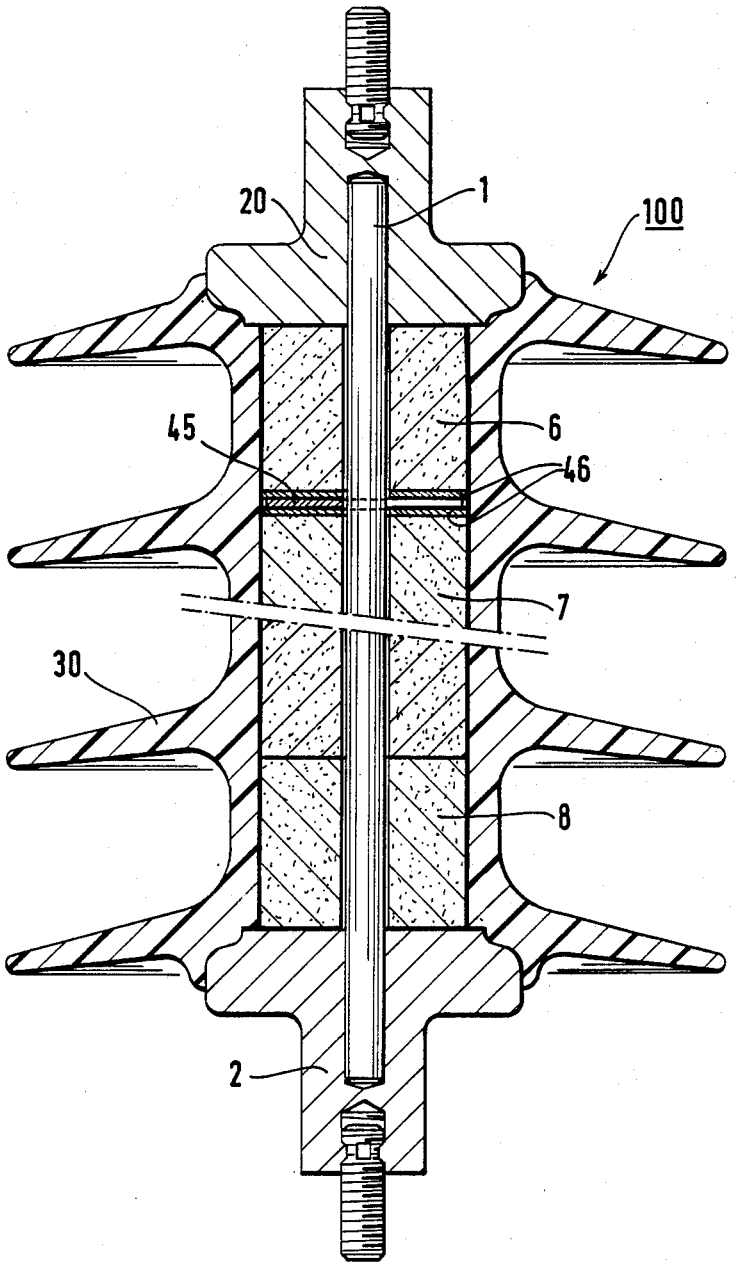
FIG. 1 is a diagrammatic fragmentary section through a lightning arrester obtained by the method in accordance with the invention.
Figure 2A:
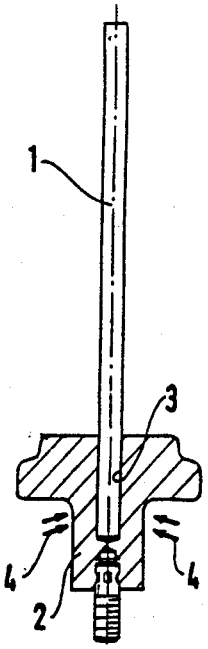

The lightning arresters 100 and 200 shown in FIGS. 1 and 2F are obtained by the method in accordance with the invention shown diagrammatically in FIGS. 2A to 2E.

Beginning with a cylindrical rod 1 made of resin-impregnated glass fibers, a first end thereof is clamped (arrows 4) in an opening 3 provided in a first end fitting 2 (see FIG. 2A).

Figure 2B:
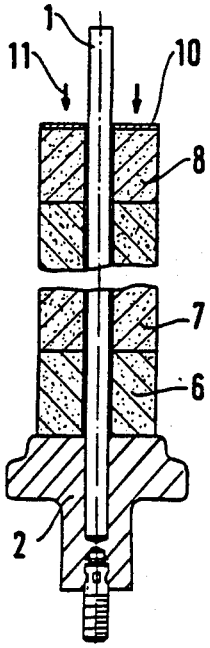

A plurality of cylindrical pellets 6, 7, 8 of zinc oxide or analogous varistor-type material are then threaded over the rod 1 in the direction of arrow 11 (see FIG. 2B). A metal washer 10 is provided at the top of the stack.

Figure 2C:
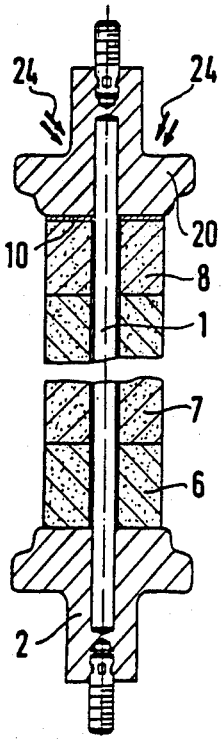

As can be seen in FIG. 2C, a second end fitting 20 is fitted on the second end of the rod 1 by clamping as represented by arrows 24. This provides a compact assembly.

FIG. 2D shows longitudinal traction 26 being applied to the two ends 25 of the end fittings so as to open up a gap which is large enough to receive a metal wedge 27 having a slot 28 within the stack.

After releasing the pressure, the FIG. 2E structure is obtained where the rod is pre-stressed and ensures that the stack of pellets 6, 7, 8, . . . is guided and held together.

An insulating mixture is then cast into the cylindrical gap between the outside face of the rod 1 and the inside faces of the pellets, thereby filling said gap. For example, this filling operation may take place through orifices (not shown) provided in the end fittings. The resulting mechanical assembly is perfectly sealed and rigid.

The last operation consists in molding a coating of fins 30 made of EPDM elastomer over said assembly, with said elastomer adherring perfectly over the entire outside surface of the assembly (FIG. 2F).

If a thick slotted metal spacer is interposed between two zinc oxide pellets, there is no need to prior fill the slot with insulating mixture since it is automatically filled when the coating 30 is molded thereover.

FIG. 1 shows the same items as FIG. 2F; the lightning arrester 100 likewise has a pre-stressed rod 1, and a slotted metal wedge referenced 45 is interposed between two pellets 6 and 7 having metal washers 46 ensuring electrical continuity. A plurality of wedges may be provided, as a function of the selected pre-stress.

Figure 3:
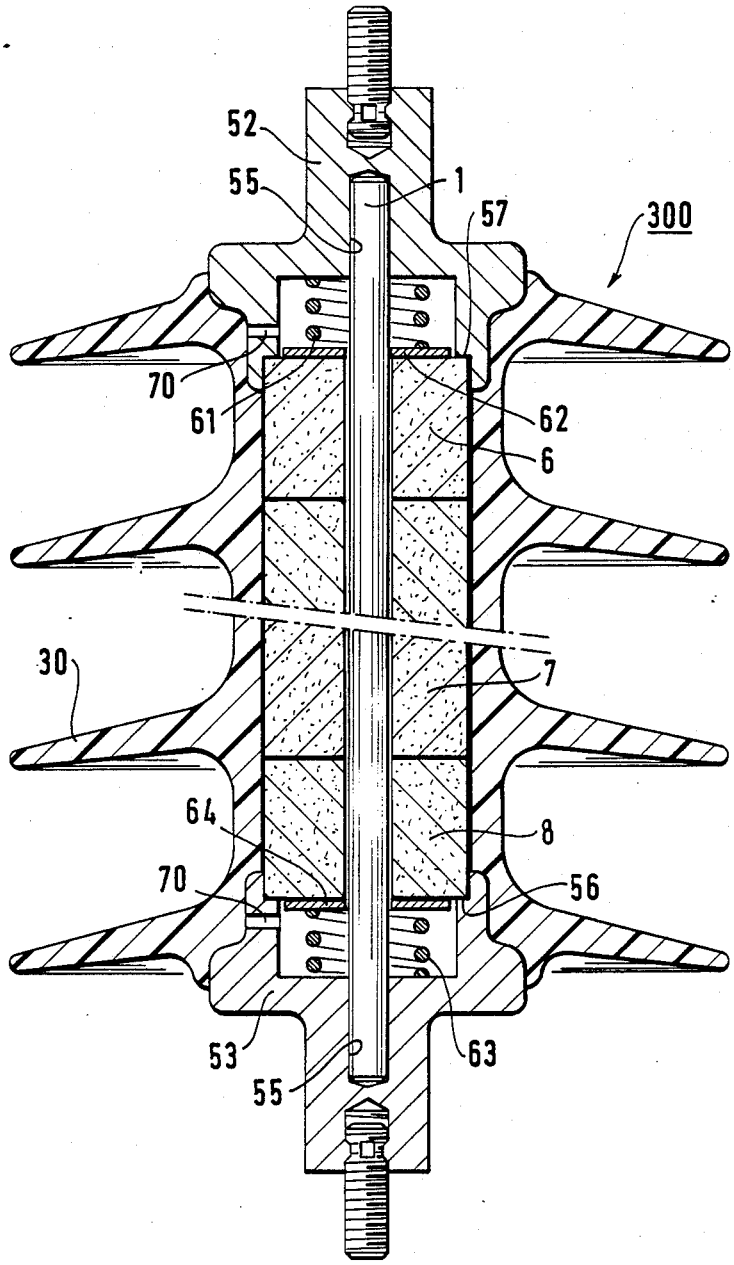
FIG. 3 is a diagrammatic fragmentary section through another embodiment of a lightning arrester obtained by the method in accordance with the invention.

The lightning arrester 300 of FIG. 3 likewise includes a rod 1 having drilled pellets 6, 7, 8, threaded thereover. The ends of the rod 1 are clamped or glued in cavities 55 provided in end fittings 52 and 53 which also include shoulders 56 and 57.

Finally, they include cavities containing springs 61 and 63 which press against the ends of the stack via metal washers 62 and 64.

An insulating mixture may be inserted via orifices 70 in order to fill the voids that may exist between the rod 1 and the pellets 6, 7, 8. This mixture is chosen so as to avoid eliminating the compression function of the springs 61 and 63. The coating 30 is then molded thereover.

As in the above case, slotted metal spacers may optionally be placed between the pellets so as to improve elastomer penetration during molding and to avoid the above-described intermediate filling operation.

Naturally the invention is not limited to the embodiments described and shown, and without going beyond the scope of the invention, any means may be replaced by equivalent means. Thus the conductive material wedges could be solid, split, in the form of a fan of blades, etc.

EPDM has been given as an example of an elastomer, but any other insulating coating may be suitable, for example, one based on a resin which may optionally be filled.

We claim:

1. A method of manufacturing a lightning arrester comprising:

stacking substantially cylindrical pellets of a varistor-type material having holes passing through the center thereof on a central rod made of stratified material to form a stack assembly, placing said stack assembly into compression between two facing faces of two end fittings coupled to said central rod of stratified material;

filling the space between the rod and said pellets with an insulating material to render said assembly perfectly rigid; and molding a coating of an elastomer of the EPDM type over said assembly to adhere said elastomer perfectly to all of the surfaces of a central core of the assembly defined by a stack of pellets and the end fittings covered by said elastomer.

2. A method of manufacturing a lightning arrester according to claim 1, further comprising interposing slotted metal spacers between the pellets, and wherein said step of filling insulating material in the between the rod and said pellets comprises filling said space with said elastomer during molding of said coating of elastomer over the assembly.

3. A method of manufacturing a lightning arrester accordng to claim 1, wherein said step of placing said stack assembly into compression comprises:

fixing a first end of said rod in a first end fitting;

threading said pellets over said rod;

fixing a second end of said rod in a second end fitting;

placing the resulting assembly under longitudinal traction to obtain a space within the stack capable of receiving a slotted wedge, inserting said wedge; and releasing the traction.

4. A method of manufacturing a lightning arrester according to claim 3, wherein said wedge is placed between two pellets together with two intermediate metal washers for ensuring electrical continuity.

5. A method of manufacturing a lighting arrester according to claim 3, wherein said wedge is placed between a pellet and one of said end fittings, together with a metal washer ensuring electrical continuity.

6. A method of manufacturing a lightning arrester according to claim 1, wherein said step of placing said stack assembly into compression comprises pressing said pellets together with said rod under longitudinal compression by disposing springs between the faces of said end fittings and the respective ends of said stack of pellets.

7. A method of manufacturing a lightning arrester according to claim 1, wherein said step of fixing the ends of said rod to said end fittings comprises crimping the ends of said rod in said end fittings.

8. A method of manufacturing a lighting arrester according to claim 1, wherein said pellets are made from a material based on zinc oxide.

9. A method of manufacturing a lightning arrester according to claim 1, wherein said step of fixing the ends of said rod to said end fittings comprises gluing the ends of said rod into said end fittings.

* * * * *